US010781409B2

(12) United States Patent
Mausberg et al.

(10) Patent No.: US 10,781,409 B2
(45) **Date of Patent: *Sep. 22, 2020**

(54) HEAVY-DUTY LAUNDRY DETERGENT WIPE WITH WASHING ACTIVE SUBSTRATE

(71) Applicant: COIN CONSULTING GMBH, Menden (DE)

(72) Inventors: Marcus Mausberg, Menden (DE); Michael Pulina, Krefeld (DE); Jost Adler, Mülheim (DE)

(73) Assignee: Coin Consulting GmbH, Menden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/506,112

(22) PCT Filed: Aug. 20, 2015

(86) PCT No.: PCT/DE2015/000416

§ 371 (c)(1),
(2) Date: Feb. 23, 2017

(87) PCT Pub. No.: WO2016/029894

PCT Pub. Date: Mar. 3, 2016

(65) Prior Publication Data

US 2018/0216042 A1 Aug. 2, 2018

(30) Foreign Application Priority Data

Aug. 25, 2014 (DE) ..... 10 2014 012 380

(51) Int. Cl.

| | |
|---|---|
| ***C11D 11/00*** | (2006.01) |
| ***C11D 17/04*** | (2006.01) |
| ***C11D 3/12*** | (2006.01) |
| ***C11D 3/386*** | (2006.01) |
| ***C11D 3/42*** | (2006.01) |
| ***C11D 1/02*** | (2006.01) |

(52) U.S. Cl.

CPC ..... *C11D 3/42* (2013.01); *C11D 1/02* (2013.01); *C11D 3/128* (2013.01); *C11D 3/1253* (2013.01); *C11D 11/0017* (2013.01); *C11D 17/041* (2013.01)

(58) Field of Classification Search

None

See application file for complete search history.

(56) References Cited

U.S. PATENT DOCUMENTS

| | | | | |
|---|---|---|---|---|
| 4,938,888 | A * | 7/1990 | Kiefer | C11D 1/662 510/295 |
| 6,750,160 | B1 * | 6/2004 | Hanaoka | C11D 3/14 15/104.93 |
| 10,465,151 | B2 * | 11/2019 | Mausberg | C11D 17/049 |
| 2003/0207630 | A1 | 11/2003 | Graham et al. | |
| 2008/0145267 | A1 * | 6/2008 | Do | A61K 8/0208 422/5 |
| 2012/0096651 | A1 * | 4/2012 | Tenbusch | C11D 11/0017 8/137 |
| 2012/0255129 | A1 * | 10/2012 | Jankura | C11D 17/046 8/137 |
| 2013/0045911 | A1 * | 2/2013 | Hutmacher | C11D 3/386 510/295 |
| 2016/0208204 | A1 * | 7/2016 | Mausberg | C11D 17/049 |

FOREIGN PATENT DOCUMENTS

| | | | |
|---|---|---|---|
| CN | 88100807 | A | 9/1988 |
| DE | 10 2010 060 126 | A1 | 4/2012 |
| DE | 202013014015 | A1 * | 2/2015 |
| EP | 0 957 158 | A1 | 11/1999 |
| RU | 2399655 | C2 | 9/2010 |
| RU | 2429285 | C2 | 9/2011 |
| WO | WO 2015/027970 | A1 * | 3/2015 |

OTHER PUBLICATIONS

International Search Report and Written Opinion dated Jan. 29, 2016 in corresponding International Appication No. PCT/DE2015/000416.

Search Report issued in corresponding the Chinese Application No. 201580057091.5, dated Nov. 21, 2018.

Search Report issued in the corresponding Russian Application No. 2017105624, dated Dec. 4, 2017.

* cited by examiner

*Primary Examiner* — Lorna M Douyon

(74) *Attorney, Agent, or Firm* — Haug Partners LLP

(57) ABSTRACT

The present invention discloses a homogeneous three-phase laundry detergent wipe and a method for manufacturing same, wherein washing active substances which are water insoluble and solid at ambient temperature are incorporated into a substrate which is solid at ambient temperature such that the substances are homogeneously distributed across the substrate after incorporation, and wherein the substrate so functionalized is impregnated with an impregnating liquid. The substances incorporated into the wipe can be zeolites and/or phyllosilicates and/or optical brighteners.

4 Claims, No Drawings

HEAVY-DUTY LAUNDRY DETERGENT WIPE WITH WASHING ACTIVE SUBSTRATE

CROSS-REFERENCE TO RELATED APPLICATIONS

This application is the National Stage entry under 35 U.S.C. § 371 of International Application No. PCT/DE2015/000416 filed on Aug. 20, 2015, published on Mar. 3, 2016 under Publication Number WO 2016/029894, which claims the benefit of priority under 35 U.S.C. § 119 of German Patent Application Number 10 2014 012 380.4 filed Aug. 25, 2014.

FIELD OF THE INVENTION

The present invention is directed to heavy-duty laundry detergent wipes for cleaning textiles and, in particular, to heavy-duty laundry detergent wipes, wherein the substrate comprises homogeneously distributed washing active components, and to a method for manufacturing same.

BACKGROUND OF THE INVENTION AND PRIOR ART

The pursuit of hygiene exists from the beginning of mankind. Hygiene eventually is an important aspect of everyday life. The hygienic approach primarily consists in maintaining the health. In addition to the general cleaning effects scent and improved cleaning power of the raw material compositions have also come under scrutiny due to extended possibilities. Cleaning power optimization is particularly characterized by the ability to extend a hygienically clean state and an improvement of the degree of cleaning.

Nowadays hygiene can be divided into the fields of body, surface and textile hygiene. The latter is divided into applications depending on textile material and color. At least since the Nineties of the $20^{th}$ century the consumer's awareness has been raised of ecological cleaning. In this regard, it is desirable to maintain the advantages of conventional washing detergents, on the one hand, and to find further innovative and ecologically feasible product solutions, on the other hand.

With the beginning of industrial production, laundry detergents have been realized as powders. This very day, a powder laundry detergent consists of a mixture of different washing active substances.

With the progress during the development of laundry detergents enzymes and other new surfactant compounds entered this market segment. In addition to the substances necessary for cleaning large amounts of filler material are added nowadays. Accordingly, no change of the consumer's dosing behavior was necessary. First attempts to omit filler material resulted in an overdosing of the surfactants due to the application the users were used to.

Then liquid washing detergents were introduced which could be dosed residue-free and, thus, offered a physical alternative to the mixture of solids of laundry detergents. However, up to now liquid washing detergents do not accomplish the cleaning level of a heavy-duty laundry detergent (i.e., a mixture of solids). This is due to the fact that a liquid washing detergent is limited to liquid components or components which are well soluble in water. The essential substances missing in a liquid washing detergent are the zeolites. The latter support dirt adsorption and brightening/color fastness during the application.

A current product trend is the simplified way of portioning the washing detergent. This can be achieved, on the one hand, by packing a liquid washing detergent in small polymer pouches. Another physical modification of the washing detergent consists in mixing a washing detergent with a fatty alcohol in order to achieve desired forms. DE 10 2010 060 126 A1 discloses a two-phase product in the form of a laundry detergent wipe, characterized by the combination of a hydrophilic carrier material and an impregnating liquid.

In contrast thereto, DE 10 2013 014 015 discloses a three-phase product, wherein a dispersion is applied to a substrate which is solid at ambient temperature. Due to the use of a dispersion for the first time, a cleaning power with the features of a powdered washing detergent (zeolites, phyllosilicates) could be achieved. Primarily hydrophobic carrier substrates have been used because the laundry detergent dispersion also has hydrophilic characteristics due to the higher amount of washing active substances as compared to the two-phase system. DE 10 2014 004 915 discloses a further improved three-phase product with a more homogeneous distribution of the washing active substances and a method for manufacturing same.

Accordingly, it is the object of the present invention to provide a laundry detergent wipe with a homogeneous distribution of the washing active substances and the solid components of the dispersion, resp., on the substrate in order to achieve a further improved distribution of the active substances and, thus, a better performance of the laundry detergent wipe.

SUMMARY OF THE INVENTION

It is an object of the present invention to provide a three-phase laundry detergent wipe which shows a more even, in particular, homogeneous, distribution of the washing active substances and the solid components of the dispersion, resp., on the substrate. It is another object of the present invention to provide a method for manufacturing same.

This object has been achieved by a method for manufacturing a homogeneous three-phase laundry detergent wipe, which is characterized by the following steps: (a) incorporating washing active substances which are water insoluble and solid at ambient temperature into a substrate which is solid at ambient temperature such that the substances are homogeneously distributed over the substrate after incorporation, (b) impregnating the substrate so functionalized with an impregnating liquid.

This object has also been achieved by a three-phase laundry detergent wipe, comprising a substrate which is solid at ambient temperature and impregnated with an impregnating liquid, characterized in that washing active substances which are water insoluble and solid at ambient temperature have been incorporated into the substrate such that the substances are homogeneously distributed over the substrate.

Advantageous embodiments of the inventive three-phase laundry detergent wipe and its manufacturing method are disclosed in the dependent claims.

DESCRIPTION OF THE PREFERRED EMBODIMENTS

Generally, the distribution of the washing active substances and the solid components of the dispersion, resp., on a substrate is not homogeneous. The inventive three-phase laundry detergent wipe with homogeneous distribution of the washing active substances and the solid components, resp., could be realized by incorporating the secondary builders (zeolite and/or phyllosilicates and/or optical brighteners), which so far have been components of the dispersion applied to the substrate, in the substrate which is solid at ambient temperature during its manufacturing process—i.e., before applying an impregnating liquid. The solid water insoluble additives can be added by means of a water bath before solidification of the substrate. Alternatively, the zeolite and/or the phyllosilicates can be sprayed onto the substrate during its manufacturing via a suspended dispersion (e.g., additive/water).

Incorporating solid water insoluble and washing active substances (here: zeolite and/or phyllosilicates and/or optical brighteners) results in an activation of the substrate with components which provide the three-phase final product with the features of a heavy duty laundry detergent. After incorporating the solids the substrate so functionalized is impregnated with an impregnating liquid which is a liquid washing detergent. Impregnation of the functionalized substrate can be obtained by immersion in an immersion bath, spraying the liquid washing detergent onto the activated substrate or moistening the substrate with the liquid washing detergent using one or more moistening rods.

The method of incorporating water insoluble solids into the substrate before applying the impregnating liquid has the following advantages:

a) applicability of larger particles
b) distribution of the washing active and water insoluble solids across the entire substrate depth (homogeneous distribution)
c) depot function of the functional solids incorporated into the substrate resulting in a longer lasting diffusion of the particles during the washing process such that they are available over a longer period of time.

Non-wovens from filament fibers (continuous filaments), in particular, from the following materials are suitable for the substrate:

polypropylene
polyethylene
viscose
polyester
polyamide
and mixtures of these raw materials The above mentioned raw materials for the substrate can be fiber mixtures (of one or more filament fibers) as well as joint fibers (jacket-core or side by side). The components described above are hydrophobic and thus have the advantageous feature to adsorb hydrophobic textile colors in the hydrophilic washing water.

The present invention can be used in all categories of laundry detergents. For example, the following laundry detergent solutions were used:

| Heavy duty laundry detergent wipe (universal): |
|---|
| anionic tensides |
| nonionic tensides |
| phosphonates/complex builders |
| C10-C18 fatty acid salts |
| optical brighteners |
| enzymes |
| stabilizers (propylene glycol, glycerine, borax, inulin) |
| scents |
| preservatives |
| soil-release polymer |
| pH regulators |

| Color laundry detergent wipe (color): |
|---|
| anionic tensides |
| nonionic tensides |
| phosphonates/complex builders |
| C10-C18 fatty acid salts |
| colorants |
| color transfer protectors |
| hydrotropes (sodium cumenesulfonate) |
| enzymes |
| stabilizers (propylene glycol, glycerine, borax, inulin) |
| scents |
| preservatives |
| soil-release polymer |
| pH regulators |

| Black laundry detergent wipe (black): |
|---|
| anionic tensides |
| nonionic tensides |
| phosphonates/complex builders |
| C10-C18 fatty acid salts |
| colorants |
| color transfer protectors |
| enzymes |
| stabilizers (propylene glycol, glycerine, borax, inulin) |
| opacifiers |
| scents |
| preservatives |
| pH regulators |

| White laundry detergent wipe (white): |
|---|
| anionic tensides |
| nonionic tensides |
| C10-C18 fatty acid salts |
| optical brighteners |
| soil-release polymer |
| color transfer protectors |
| enzymes |
| stabilizers (propylene glycol, glycerine, borax, inulin) |
| colorants |
| opacifiers |
| scents |
| preservatives |
| pH regulators |

| Fine laundry detergent wipe: |
|---|
| anionic tensides |
| nonionic tensides |
| C10-C18 fatty acid salts |
| phosphonates/complex builders |
| color transfer protectors |
| enzymes |
| stabilizers (propylene glycol, glycerine, borax, inulin) |
| scents |
| defoamers |
| preservatives |
| pH regulators |

| Wool laundry detergent wipe: |
|---|
| anionic tensides |
| nonionic tensides |
| amphoteric tensides |
| C10-C18 fatty acid salts |
| phosphonates/complex builders |

-continued

| Wool laundry detergent wipe: |
| --- |
| color transfer protectors |
| scents |
| preservatives |
| opacifiers |
| conditioners |
| pH regulators |

The liquid washing detergent of the impregnating liquid can have a viscosity greater than 500 mPas. Furthermore, all known components of a heavy-duty laundry detergent can be included.

The invention claimed is:

1. A method for manufacturing a homogeneous three-phase laundry detergent wipe, consisting of the following steps:

(a) providing washing active substances which are water insoluble and solid at ambient temperature, wherein the washing active water insoluble substances comprise zeolites and/or phyllosilicates;

(b) providing a substrate which is solid at ambient temperature;

(c) incorporating said washing active substances into said substrate such that the substances are homogeneously distributed over the substrate after incorporation; and (d) impregnating the substrate so functionalized with an impregnating liquid comprising enzymes, wherein the final three-phase laundry detergent wipe consists of a liquid phase and two solid phases.

2. The method of claim 1, wherein the substrate consists of at least one continuous filament or a joint fiber.

3. The method of claim 1, wherein the substrate consists of at least one hydrophobic synthetic fiber such that it provides color adsorption.

4. The method of claim 1, wherein the impregnating liquid is a liquid washing detergent.

* * * * *